United States Patent [19]

Goseberg

[11] Patent Number: 4,748,437

[45] Date of Patent: May 31, 1988

[54] CONNECTOR FOR A PICTURE TUBE

[75] Inventor: Walter Goseberg, Hanover, Fed. Rep. of Germany

[73] Assignee: Telefunken Fernseh und Rundfunk GmbH, Hanover, Fed. Rep. of Germany

[21] Appl. No.: 886,358

[22] Filed: Jul. 17, 1986

[30] Foreign Application Priority Data

Jul. 18, 1985 [DE] Fed. Rep. of Germany ..... 3525639

[51] Int. Cl.[4] ..... H01C 1/01

[52] U.S. Cl. ..... 338/315; 338/197; 338/334; 315/3; 313/477 HC

[58] Field of Search ..... 338/174–179, 338/315, 163, 199, 197, 333, 334; 315/1, 3; 313/331, 477 HC, 325; 361/423; 339/155 R, 156 R, 156 T

[56] References Cited

U.S. PATENT DOCUMENTS 3,767,951 10/1973 Dumas et al. ..... 313/325 X
4,400,645 8/1983 Simovits, Jr. et al. ..... 315/3 X
4,402,037 8/1983 Iwamura et al. ..... 315/3 X

FOREIGN PATENT DOCUMENTS 2084434 4/1982 United Kingdom .

*Primary Examiner*—E. A. Goldberg
*Assistant Examiner*—M. M. Lateef
*Attorney, Agent, or Firm*—Spencer & Frank

[57] ABSTRACT

A picture tube connecting device, including a common integral insulating housing, connector contacts in the common housing for electrically contacting a picture, and at least one potentiometer, including a focus adjusting potentiometer in the housing, electrically connected to the connector contacts for conducting electrical current to the picture tube via the connector contacts. A high voltage connector is provided for electrically connecting a high voltage to the focus adjusting potentiometer.

10 Claims, 1 Drawing Sheet

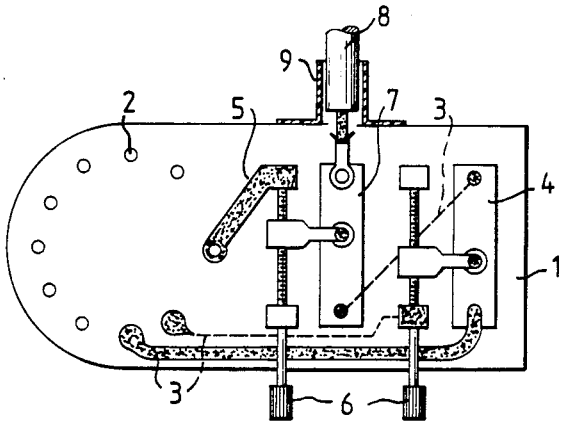
8
9
2
5
7
3
4
1
3
6

CONNECTOR FOR A PICTURE TUBE

BACKGROUND OF THE INVENTION

In conventional television apparatus, the connector for the picture tube is soldered on a printed circuit board. This circuit board includes further constituent parts such for example as potentiometers for the adjustment of the focussing voltage for the picture tube or for grey balance. These potentiometers are connected by means of printed conductors with the junction points for the picture tube connector. in addition, the focussing voltage, which is applied to a grid of the picture tube by way of the tube connector amounts for example to around 8 KV. This relatively high voltage cannot be applied without precaution by means of a printed conductor of the circuit board, because arcing and with it leakage would occur. Therefore, and for the application of the focussing voltage, special provisions are needed, for example a separate insulated wire. This wire must be soldered on the one hand to a connector of the potentiometer and on the other hand to the corresponding contact of the connector. This solution requires therefore additional applications of solder which cannot be made in the dip soldering process. In addition, such applications of solder are undesirable in the vicinity of high voltage, because the unavoidable flux vapour can have a disadvantageous effect on the degree of join. To this is added the fact that the making of the solder connections requires additional manual or machine operations.

The potentiometer for the focussing voltage must be provided with a housing consisting of high quality insulating material which guarantees for the high voltage an adequate protection against touch. In addition a high quality insulator is also necessary for the tube connector which insulator guarantees on the one hand good thermal stability and on the other hand adequate insulation of the individual contacts one to another.

SUMMARY OF THE INVENTION

The problem is solved by the invention described in the first claim. Advantageous developments are described in the sub-claims.

In principle, the invention lies in that the picture tube connector and potentiometers are arranged as a unit in a common electrically insulating housing. This rational solution is advnatageous because at least two contacts of the focus regulator must be joined with the picture tube connector namely, chassis and slider take-off from which the adjusted focussing voltage is derived. The joints can be made without soldering.

It is possible to make the joints by arranging shaped metal parts in recesses of the insulating housing. It is also possible to connect the focussing voltage to the picture tube connector point by way of an insertable conductive rubber part.

In addition, it is possible to introduce a further potentiometer into the common insulating housing to form an assembly unit with the focus regulator and picture tube connector. Thus for example, the potentiometer for the adjustment of a screen grid voltage for grey balance, which is electrically in series with the focus control, can be arranged in the insulating housing.

BRIEF DESCRIPTION OF THE DRAWING

The invention will be explained with reference to the drawing, as applied to a practical example.

The FIGURE shows in elevation a picture tube connector as an assembly unit with focus regulator and screen grid potentiometer.

DETAILED DESCRIPTION OF THE PREFERRED EMBODIMENT

Contacts 2 for the picture tube connector are arranged together with the potentiometers 4 and 7 in a single insulating part forming the integral insulating housing 1 on the same side of housing 1. The potentiometers are shown as spindle potentiometers, of which the sliders can be adjusted by the adjusting knobs 6. The connections between the potentiometers and the connector contacts 2 are made by the conductors 3,5 which as shaped parts are let into the housing 1. The connecting piece 5 for applying the focussing voltage can also be realised as a conducting rubber part such as silicon rubber, as the current and thus voltage drop in this connection is small. The application of voltage to the potentiometers 4 and 7 is effected through the conductor 8, which receives the required high voltage from the high voltage transformer. This conductor can be inserted into a socket 9 of the insolating housing.

By using an isolating cap, which is not shown, it is possible to protect the potentiometer and focus connecting point of the connector against inadvertent touching.

I claim:

1. A picture tube connecting device, comprising:

a single insulating part forming a common integral housing;

connector contacts in said common housing, said connector contacts being disposed on a side of said common housing and forming a means for directly mechanically and electrically contacting a picture tube on said side of said common housing; and conducting means, in said common housing and electrically connected to said connector contacts, for conducting electrical current to the picture tube via said connector contacts, said conducting means including at least one potentiometer in said housing electrically connected to said connector contacts.

2. A device as in claim 1, wherein said at least one potentiometer is disposed on said side of said common housing.

3. A device as in claim 1, wherein said conducting means further includes shaped metal parts electrically connecting said at least one potentiometer and said connector contacts.

4. A device as in claim 1, wherein said conducting means further includes electrically conductive rubber parts electrically connecting said at least one potentiometer and said connector contacts.

5. A device as in claim 4, wherein said electrically conductive rubber parts are formed of silicon rubber.

6. A device as in claim 1, wherein said at least one potentiometer includes a focus adjusting potentiometer, said device including means, including said focus adjusting potentiometer, for adjusting the focus of the picture tube.

7. A device as in claim 6, wherein said conducting means further includes shaped metal parts electrically connecting said at least one potentiometer and said connector contacts.

8. A device as in claim 6, wherein said conducting means further includes electrically conductive rubber parts electrically connecting said at least one potentiometer and said connector contacts.

9. A device as in claim 8, wherein said electrically conductive rubber parts are formed of silicon rubber.

10. A device as in claim 3, further comprising high voltage connector means for connecting a high voltage to the focus adjusting potentiometer.

* * * * *